United States Patent [19]

Dadiras et al.

[11] 4,423,983

[45] Jan. 3, 1984

[54] MARINE RISER SYSTEM

[75] Inventors: Nickiforos G. Dadiras, Dallas; Ronald D. Baugh, Lewisville, both of Tex.

[73] Assignee: Sedco-Hamilton Production Services, Dallas, Tex.

[21] Appl. No.: 292,957

[22] Filed: Aug. 14, 1981

[51] Int. Cl.[3] ..... E21B 33/035

[52] U.S. Cl. ..... 405/195; 166/350; 405/224; 175/7

[58] Field of Search ..... 405/195, 224, 225; 175/5-7; 166/350, 359, 367

[56] References Cited

U.S. PATENT DOCUMENTS

| | | | |
|---|---|---|---|
| 3,817,325 | 6/1974 | Mott et al. | 175/7 X |
| 3,983,706 | 10/1976 | Kalinowski | 405/224 |
| 3,999,617 | 12/1976 | Ilfrey et al. | 175/7 |
| 4,142,584 | 3/1979 | Brewer et al. | 175/7 X |
| 4,198,179 | 4/1980 | Pease et al. | 405/195 |
| 4,228,857 | 10/1980 | Nobileau | 175/7 X |
| 4,234,047 | 11/1980 | Mott | 175/5 |

*Primary Examiner*—Dennis L. Taylor

*Attorney, Agent, or Firm*—Hubbard, Thurman, Turner & Tucker

[57] ABSTRACT

A marine riser system for a petroleum production platform or other structure includes a central support column extending from a subsea manifold vertically upward to a connection with a riser tensioner assembly mounted on a floating platform. The central support column includes one or more vertically spaced levels of radially extending arms which are pivotally connected to the central support column and are held in generally horizontally projecting positions by individual hydraulic cylinder actuators. Each of the support arms is adapted to be connected to a riser conduit and to apply a predetermined upward tension to the conduit whereby the entire riser system is maintained under a predetermined tension with respect to the support column and to permit motion of the platform structure under varying sea conditions. The riser system includes a plurality of vertically spaced apart guide funnels supported on sets of foldable arms.

18 Claims, 6 Drawing Figures

MARINE RISER SYSTEM

BACKGROUND OF THE INVENTION

1. Field of the Invention

The present invention pertains to a marine riser assembly having an array of individual risers disposed about a central support column wherein the column is tensioned by a riser tensioner assembly and the individual risers of the array are tensioned by hydraulically actuated support arms mounted on the central column.

2. Background Art

In the art of offshore well drilling and production of petroleum, it is known to provide floating structures to which are connected elongated tubing strings or risers. The opposite ends of the risers are connected to respective wellheads on the seafloor or to a central manifold for a plurality of wells and associated conduits. In order to permit the movement of the platform or other floating structure under varying sea conditions without damaging or separating the risers connected thereto various types of heave compensator or tensioner mechanisms have been developed to maintain a predetermined tension on the riser while accommodating the movement of the associated floating structure.

In the development of floating production platforms and the like, wherein a substantial number of separate risers extend upward from a manifold on the seafloor or from a plurality of wellheads on the seafloor, the practice in the art has been to provide individual tensioner assemblies for each riser. Such an arrangement can become extremely complicated when a substantial number of separate risers or conduits, each being connected to a different well, are required or desired to be connected to the platform for delivering the oil produced from the wells. For example, it is not uncommon to have conduits or risers for as many as 15 to 20 wells being connected to a floating platform. It is also preferred in such arrangements to gang the risers in an array so that support structure for the risers may be provided to prevent their swaying to and fro as a result of sea currents and wave action. The relatively close spacing of the individual risers as required by the support structure further complicates the mechanism for tensioning each riser. Accordingly, it has become necessary and desirable to provide improved means for tensioning a plurality of vertically disposed conduits or risers extending from a substantially fixed point at or near the seafloor to a structure on the sea surface which is likely to undergo movement with respect to the seafloor. Such desiderata have been met by the improved riser arrangement and tensioning assembly of the present invention.

SUMMARY OF THE INVENTION

The present invention provides an improved arrangement of multiple conduits extending from a submerged location at or near the seafloor to a floating production platform or the like for conveying fluids from the seafloor to the platform or from the platform to the seafloor while providing for servicing of a plurality of submarine wells.

In accordance with the present invention, there is provided an arrangement of a plurality of marine risers disposed in an array around a central support column which is supported by a riser tensioning assembly mounted on a floating platform or the like. Each of the individual risers of the array is provided with a tensioning mechanism connected to the central support column. Accordingly, the need for conventional mechanism connected to the individual risers and the platform is eliminated.

The present invention also provides an improved arrangement of a plurality of generally vertically extending marine risers or conduits which are grouped in a substantially circular pattern about a central riser or support column and wherein each riser of the group is supported at a point near its upper end by a radially extending support arm mounted on the central column. Each of the respective support arms is provided with a hydraulic actuator which imposes a predetermined upward bias on the support arm and on the riser or conduit connected thereto. Accordingly, a predetermined tension on the individual risers is maintained with respect to the central support column and the central support column itself is supported with respect to the floating platform by a riser tensioning assembly mounted on the platform.

In accordance with another aspect of the present invention, there is provided a circular array of a substantial number of vertically extending marine risers or conduits, each provided with a support arm and wherein the support arms are arranged in one or more radial spoke patterns at vertically spaced apart positions on the central support column. Each of the arms of the spaced apart sets of arms is connected to a linear hydraulic actuator which is also connected to the central support column to provide for moving the arm between a vertically extending folded position and a generally horizontally extending working position. The hydraulic actuators not only provide for raising and lowering the support arms, but also for applying a predetermined tension on the associated riser or conduit. The plural hydraulic actuators may be conveniently controlled from a control station on the platform.

The present invention still further provides for an improved arrangement of a substantial number of marine risers for conducting petroleum or other liquids between a subsea manifold system and a floating platform wherein the risers or conduits are arranged in a generally circular pattern around a central support column and further wherein the central support column is provided with plural sets of vertically spaced apart folding guide arms connected to the support column. The vertically spaced guide arms are provided at their distal ends with guide funnels for guiding the riser sections to facilitate makeup and breakout operations of the marine riser system. The plural sets of guide arms are funnels are also adapted to provide for minimizing the lateral swaying movement of the individual risers while they are in place connected to the subsea manifold and the platform.

The arrangement of the individual folding guide arms and the folding riser support arms, all connected to the central support column, provides an improved riser system wherein the sections of the central support column may be more easily lowered into position through openings in the decks of a platform structure for making up the riser system.

Those skilled in the art will recognize other superior features and advantages of the present invention upon reading the detailed description which follows in conjunction with the drawings.

DESCRIPTION OF THE PREFERRED EMBODIMENT

Figure 1:
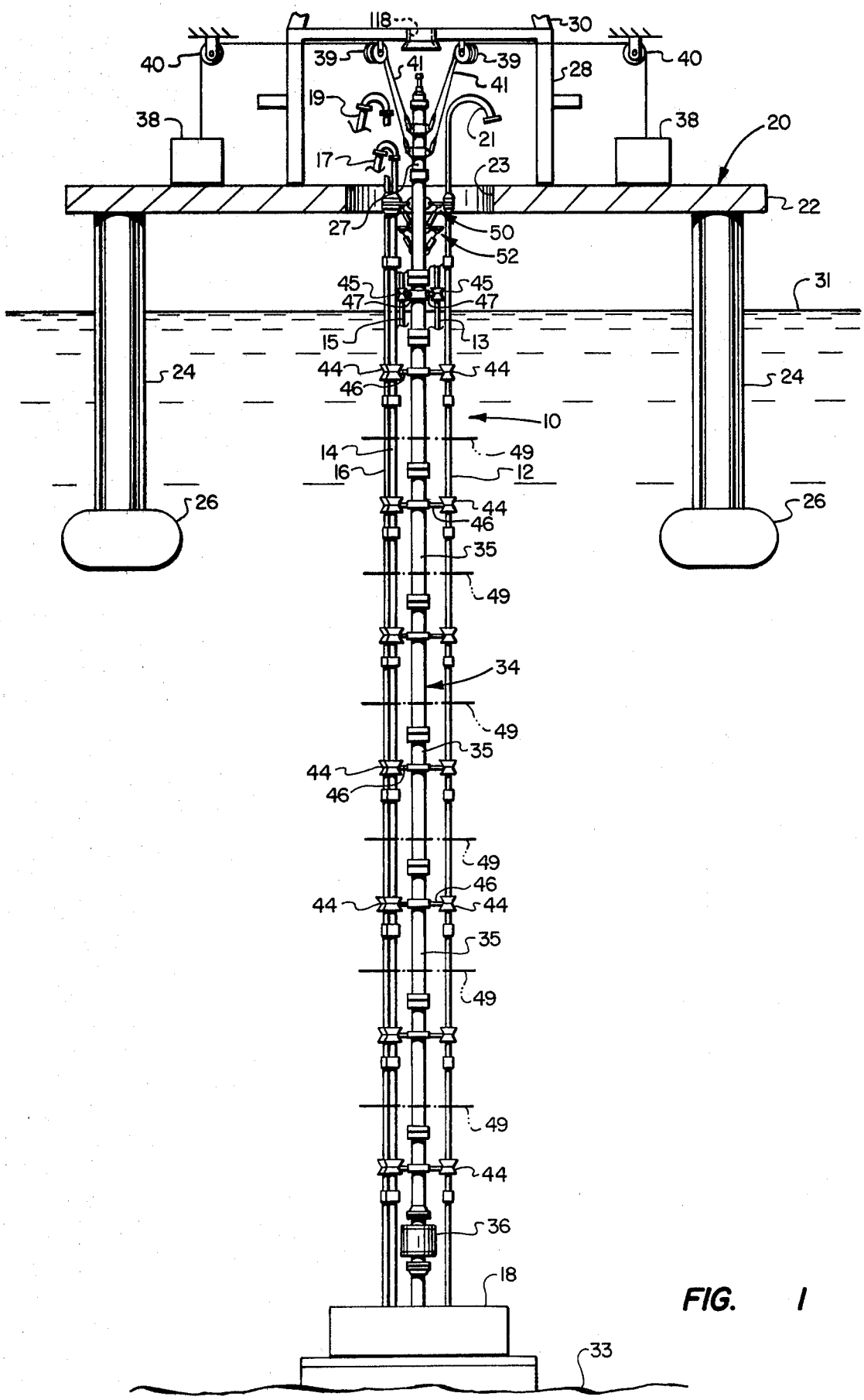
FIG. 1 is a vertical elevation in somewhat schematic form showing the marine riser system of the present invention connected to a floating platform structure.

In the description which follows, like parts are referred to with the same reference numerals throughout the specification and drawings, respectively. The drawings are not necessarily to scale and certain parts have been exaggerated in scale in order to show the details of the inventive features more clearly. Certain structural details have been eliminated from some of the drawing figures in the interest of clarity and conciseness.

Referring to FIG. 1, there is illustrated a marine riser system for use in conducting fluids, either upwardly or downwardly, between a plurality of subsea wells and a floating platform or the like. The marine riser system of the present invention, generally designated by the numeral 10, comprises a plurality of individual risers or conduits 12, 13, 14, 15 and 16 which extend from a manifold assembly 18, mounted on the seafloor, substantially vertically upward to a floating structure comprising a drilling and/or production platform, generally designated by the numeral 20. The platform 20 includes a main deck structure 22 mounted on a plurality of generally vertically depending buoyant legs 24 which are fixed to hulls 26. In the drawing FIG. 1, only two leg and hull structures are shown, although those skilled in the art will appreciate that the platform 20 would include a sufficient number of leg and hull structures to provide a stable floating structure. The platform 20 also includes a substructure 28 for supporting a conventional derrick 30 which may be used in connection with drilling and/or servicing the riser system 10. The deck 22 includes a central opening 23 through which the upper end of the riser system 10 projects. The buoyancy of the platform 20 may be controlled by flooding the hulls 26 as well as portions of the legs 24 to provide a relatively stable floating structure which may be maintained generally above the manifold 18 floating on a sea 31.

In accordance with conventional practice the platform 20 may be anchored generally in the position shown by suitable means, not shown. However, under varying sea conditions including currents and/or wave action, the platform 20 is suceptible to some horizontal and vertical movement since it is a floating structure. In this respect, it is necessary to provide means for maintaining a predetermined tension on the riser system 10 regardless of the vertical movement of the platform, in particular, to accommodate the movement of the platform without causing structural failure of the riser system. Heretofore, it has been conventional practice to provide tensioning means interconnecting each individual conduit with the floating platform structure. Those skilled in the art will appreciate the problems associated with providing for each riser the complex mechanism which normally includes a system of cables or chains and sheaves connected to suitable mechanism for maintaining a tension force on the riser while accommodating vertical movement of the platform. This mechanism requires a considerable amount of space and prevents the grouping of multiple risers in a suitable array or presents significant problems in mounting the tensioning mechanism for closely spaced multiple risers.

However, in accordance with the present invention, the riser system 10 is provided with an improved arrangement of multiple risers together with a unique and reliable tensioning mechanism which greatly reduces the complexity of the tensioner apparatus required to maintain a predetermined tension on each of a plurality of individual risers.

Figures 2, 6:
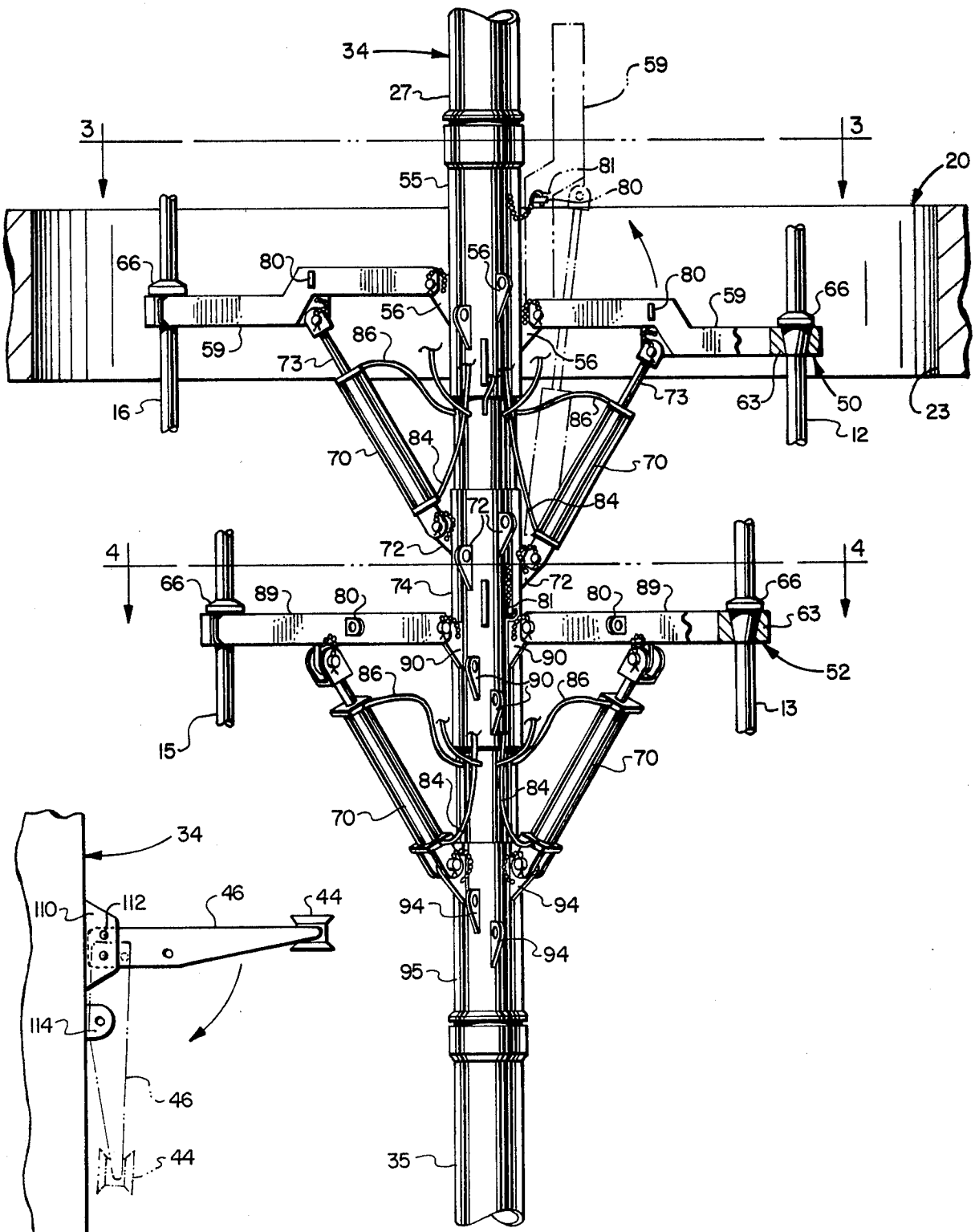
FIG. 2 is a detail vertical elevation view on a larger scale of the central support column for the marine riser system and showing the actuators for the support arms of the individual risers of the array.
FIG. 6 is a detail elevation view of one of the support arms for the riser guide funnels.

In the riser system illustrated in FIG. 1, only five of a significant number of risers are illustrated in the interest of clarity and conciseness. In like manner, only two risers and associated support structure are illustrated in FIG. 2. It is not unusual, in fact, that as many as 15 to 20 individual conduits or risers may be required to be connected to a subsea apparatus such as the manifold 18. The manifold 18 may be provided for connecting a plurality of conduits, not shown, one to each of the risers of the system 10 and leading to individual wells, not shown, spaced apart in a subsea well field or the like. The manifold 18 also could represent a head assembly for a plurality of wells drilled relatively close together into the seafloor 33 but being deviated from each other toward respective subterranean production zones.

The improved riser system illustrated in FIG. 1 includes a central support column 34 which may comprise a multiple section cylindrical conduit connected at its lower end to the manifold 18 and extending vertically upward through the opening 23 in the deck 22. The support column 34 preferably includes a flexible coupling 36 which may be of a known type and which permits limited vertical and/or lateral movement of the support column to accommodate some movement of the main portion of the column with respect to the manifold 18. However, it is necessary to maintain the central riser or support column 34 under a predetermined tension with respect to the platform 20 to prevent damage to the column and/or parting of one of the column sections 35. Each of the sections 35 of the central support column is provided with coupling means such as pin and box type joints, bolted flanges or other stab type couplings to provide for making up and breaking down the support column as needed. The support column 34 comprises a riser itself and may include within its central passage 37, see FIGS. 3 and 4, means for conducting fluids to and from the manifold 18, for example. The support column 34 may also include other fluid conductors disposed within its passage 37.

Figure 5:
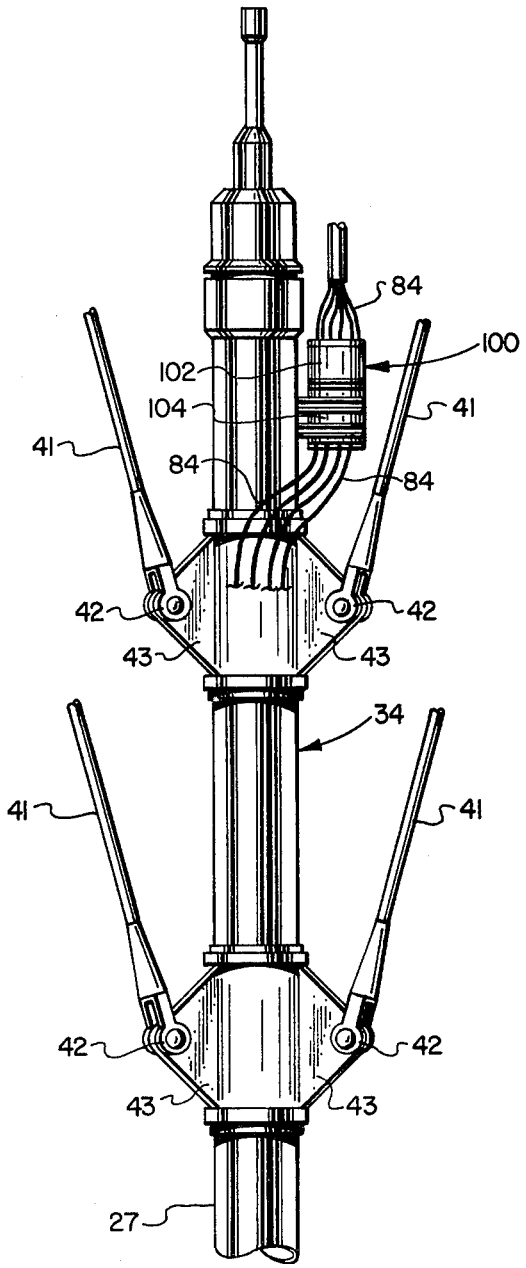
FIG. 5 is a vertical elevation detail of the connections between the central support column and a tensioner assembly.

Referring to FIGS. 1 and 5, the support column 34 is connected at its upper end to a riser tensioner assembly including tensioner mechanisms 38. The mechanisms 38 may be one of several types suitable for providing a predetermined tension on the support column when the platform 20 is subjected to vertical and/or lateral movement on the sea. The tensioner mechanism for the central support column 34 is shown in schematic form and forms no part of the present invention. The tensioner mechanisms 38 include a system of sheaves 39 and 40, mounted on the platform structure and supporting flexible cables 41 extending from the tensioner mechanisms to suitable connections to the central support column 34 provided by the clevises 42 and lugs 43 as shown in FIG. 5. The lugs 43 are fixed to an uppermost section 27 of the support column 34 as indicated in FIGS. 1 and 5. The arrangement of the flexible cables 41 and the associated connecting lugs 43 may be in a triangular pattern as indicated in FIG. 5, however, only two lugs 43 and cables 41 are shown for each of the two levels of connection to the central support column as illustrated in FIG. 5. Accordingly, the central support column 34 is supported with a predetermined tension applied thereon to support the riser system and to maintain it in a substantially fixed position extending vertically from the manifold 18 and without being subjected to parting stresses or column bending due to movement of the platform 20.

Referring again to FIG. 1 in particular, the upper ends of each of the representative risers may be connected to flexible hoses or the like, such as the hoses 17 and 19, which lead to further processing equipment, not shown, for the fluids being conducted through the risers 14 and 16, respectively. The riser 12 is also shown provided with a conduit 21 for conducting fluids therefrom to the platform 20. The individual risers 12, 14 and 16 are maintained in a predetermined position with respect to the central support column by a plurality of guide funnels 44 which are connected to respective foldable arms 46 projecting radially from the central support column 34 at a plurality of vertically spaced apart positions on the support column. The guide funnels 44 are provided to limit the lateral movement of the individual risers of the riser array with respect to the central support column 34 and also provide the function of guiding the risers 12, 14 and 16, for example, during the makeup and breakdown operations of each riser.

Referring to FIG. 6, one of the support arms 46 is illustrated in detail and is shown in the radially extended position as well as the folded position, the latter position indicated by the phantom lines.

The arm 46 is preferably provided with a bifurcated distal end portion suitably supportive of the funnel 44. The arm 46 is also pivotally mounted on a section of the support column 34 by a clevis 110 which is adapted to secure the arm in the extended position by a lock pin 112. The arm 46 is also secured in the folded position by a bracket 114 through which the pin 112 may be alternatively inserted to retain the arm in the indicated position. The specific mechanism for supporting the arms 46 in the extended and folded positions may take various forms but the general arrangement providing folding the arms as described, greatly facilitates the ease with which the support column 34 may be made up or broken down during the respective installation and removal of the riser system.

The risers 13 and 15 are supported by respective guide funnels 45 connected to radially extending arms 47 which are also foldably mounted on the central support column 34 in a manner similar to the arms 46. Additional levels of support arms 47 and guide funnels 45 are indicated schematically by the horizontal reference lines 49 in FIG. 1. The individual risers 12, 13, 14, 15 and 16 are made up of elongated sections of pipe or conduit having suitable stab type couplings which permit makeup and breakout operations in the assembly and disassembly thereof. As pointed out previously herein, the individual risers of the riser system as well as the central support column may be provided for conducting well fluids from the manifold 18 to the surface or for running tubing from the platform 20 into individual wells connected to the manifold 18 for various well development and servicing operations. Regardless of the particular use of the individual risers of the riser system 10, it is important that each of the risers be maintained at a fairly constant predetermined tension with respect to the platform 20 as well as the central support column 34. To this end, an improved arrangement and mounting for the individual risers, typified by the risers 12 through 16, is provided in accordance with the present invention.

Figure 3:
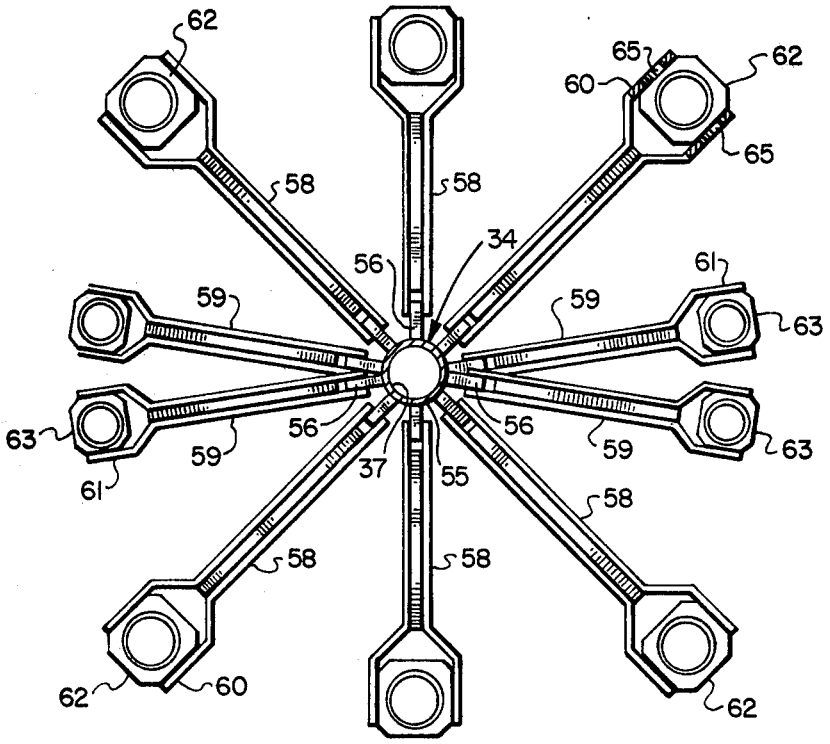
FIG. 3 is a section view taken along the line 3—3 of FIG. 2 and showing the pattern of the support arms at one level.
Figure 4:
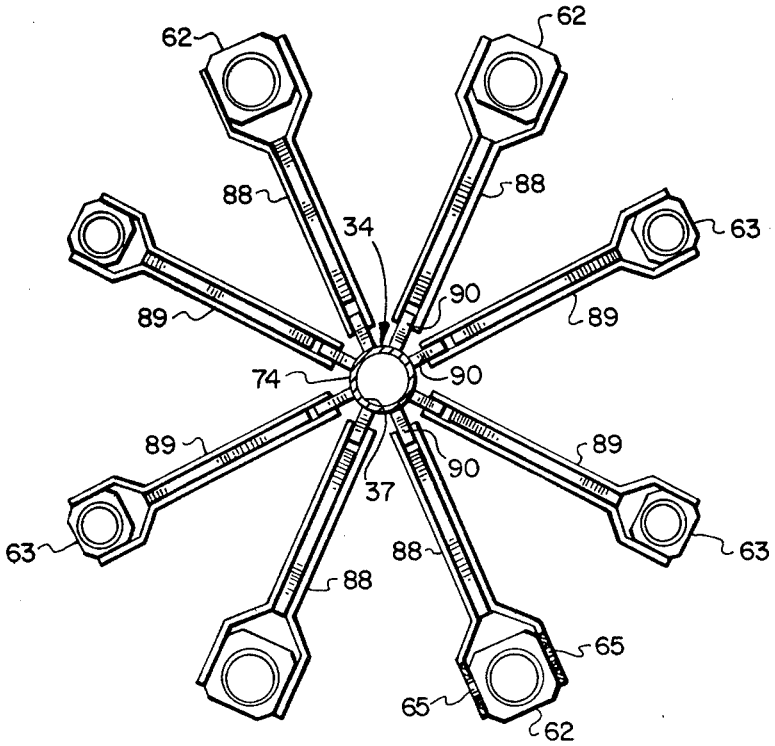
FIG. 4 is a section view taken along the line 4—4 of FIG. 2 and showing the pattern of the support arms at another level.

Referring now particularly to FIGS. 2, 3 and 4 of the drawings, the riser system 10 includes two levels of an array of radially projecting support arms, which levels are respectively designated by the numerals 50 and 52 in FIGS. 1 and 2. Additional levels of support arms or only a single level could be provided according to the number of risers and spacing requirements therefor. With reference to the array of support arms provided at the level 50, as illustrated in FIG. 2, the central support column 34 includes a section 55 connected to the lower end of section 27. The column section 55 includes a plurality of radially disposed lugs 56 spaced apart around the circumference of the section 55 and adapted to pivotally support a plurality of radially projecting support arms 58 and 59. The support arms 58 and 59 are each provided with bifurcated distal end portions 60 and 61, respectively, which are adapted to have mounted thereon support bushings 62 and 63. The support bushings 62 and 63 are connected to the bifurcated portions of the arms 58 and 59, respectively, by laterally projecting trunnion portions 65, as shown by way of example for one of the bushings 62, to provide for pivotal movement of the bushings about an axis substantially perpendicular to a radial line designating a longitudinal center line of the respective support arms. Accordingly, pivotal movement of the support arms 58 and 59 about their connections with the lugs 56 can result in the bushings 62 and 63 maintaining a generally horizontal attitude of their upper surfaces, for a purpose to be understood after further description of the associated structure.

Referring further to FIG. 2, the support arms 58 and 59 are each adapted to support a respective riser such as one of the risers 12 through 16. As shown in FIG. 2, the riser 12, by way of example, is provided with a coupling portion having a flange 66 which is engaged with the upper surface of a bushing 63 so that, upward movement of the support arm 59 will impose a vertical tension on the riser 12 throughout its length below the arm 59, viewing FIGS. 1 and 2. Although omitted in the interest of clarity and conciseness of the description herein, each of the individual support arms 58 and 59 at level 50 are adapted to support a riser such as one of the risers 12, 14 and 16 and wherein each riser would be provided with a coupling portion having a flange such as the flange 66 engageable with a bushing 62 or 63 such that the riser would not be movable vertically downward through the bushing and would be supported by the support arm as indicated in FIG. 2.

The radial inner end of each of the support arms 58 and 59 comprises a clevis portion which is adapted to be pivotally mounted on respective ones of the lugs 56 for pivotal movement between a folded, generally vertically disposed position, as indicated by the dashed lines for the support arm 59 in FIG. 2, to a generally laterally extending working position shown by the solid lines. Movement of the support arms 58 and 59 between their working and retracted position is provided by hydraulic actuators comprising double acting linear cylinder type actuators designated by the numeral 70 in FIG. 2. The cylinders 70 are provided with clevis portions which are attached to lugs 72 mounted on a section 74 of the central support column disposed below the section 55. Again, in the interest of clarity and conciseness only two cylinders 70 are shown for the array of support arms 58 and 59 of the level 50. Each of the cylinders 70 is provided with a linear extensible piston and rod assembly 73, the distal end of which is connected to a suitable lug formed on the support arms 58 and 59. The support arms 58 and 59 may each be provided with a latching mechanism comprising a hook eye 80 and a latch hook 81 connected to a suitable flexible chain mounted on the central support column section 55 whereby the arms 58 and 59 may be maintained in a folded position as indicated by the dashed lines in FIG. 2. The cylinders 70 are each provided with hydraulic fluid supply lines 84 and 86 for conducting pressure fluid to actuate the cylinders between their extended positions for placing the support arms 58 and 59 in a vertical folded position and the somewhat retracted positions wherein the support arms 58 and 59 are supported for applying a predetermined tension to the individual risers of the riser array. A supply line 84 for each of the cylinders 70 may be connected to a source of hydraulic fluid, not shown, on the platform 20 together with suitable control valves for applying a predetermined fluid pressure in the cylinders to hold the arms 58 and 59 in the working position shown by the solid lines in FIG. 2. The fluid lines 86 may also be connected to the aforementioned source of hydraulic fluid through suitable control valves or a common manifold connected to only one control valve whereby the arms may be lowered in unison. When the arms 58 and 59 are in the working position, pressure fluid is supplied to the lines 84 under a controlled pressure to apply a predetermined vertically upward directed tension force on the individual risers of the array represented by the upper level 50. Accordingly, since the central support column 34 is connected to a riser tensioning assembly, to maintain a predetermined tension on the support column, it is only necessary that the cylinders 70 be pressurized to place a predetermined tension on the individual risers of the array with respect to the central support column in order to maintain tensioning of the entire riser system 10 with respect to the platform 20.

In order to maximize the number of individual risers in the array of the riser system 10, the second level 52 of the system is provided with a plurality of radially projecting foldable support arms 88 and 89 similar to the support arms 58 and 59 but spaced circumferentially with respect to the longitudinal axis of the support column 34 in such a way as to provide for support of individual risers between each of the risers of the array represented by the first level 50. Each of the support arms 88 and 89 is also provided with a clevis portion at its radial innermost end which provides for pivotal connection to lugs 90 on the portion 74 of the central support column. The arms 88 and 89 are also bifurcated at their distal ends to provide for pivotal mounting of bushings 62 and 63 as illustrated in FIG. 4. Again, in the interest of clarity and conciseness the individual risers associated with each of the support arms 88 and 89 are not shown in order to simplify the drawing and the detailed description herein.

As illustrated in FIG. 2, each of the support arms 88 and 89 are also supported in the generally horizontally extending position by respective hydraulic cylinders 70 connected at their lower ends to lugs 94 mounted on a portion 95 of the central support column 34. The cylinders 70 of level 52 of the riser array are also provided with fluid supply and return conduits 84 and 86 which, like the cylinders of the level 50, are connected to the aforementioned source of hydraulic fluid. The lines 86, not necessarily requiring individual control, may be conducted through suitable bulkhead fittings, not shown, in the sidewall of the central support column 34 and extend therewithin up to the platform 20. The supply lines 84 as well as the lines 86 may also be grouped in a suitable harness and extend upward to a suitable multiple coupling, illustrated in FIG. 5 and generally designated by the numeral 100. The coupling 100 is mounted on the central support column 34 as shown and may include separable portions 102 and 104 adapted to provide for collectively connecting and disconnecting each of the lines 84 to the aforementioned source of hydraulic fluid.

As indicated, all of the riser tensioning arms of the levels 50 and 52 are not arranged in exactly the same plane. In order to maximize the number of risers that may be arranged in the array, the vertical positioning of each of the arms may be staggered somewhat in order to provide for mounting the arms on the portions 55 and 74 of the central support column.

In making up the riser system of the present invention, sections 35 of the central support column 34 are suitably connected together and lowered from the derrick 30 through the bushing 118 and stabbed into a coupling, not shown, at the manifold 18. As each section 35 of the central support column is lowered from the platform 20, the arms 46 and 47 are pivoted and locked in their radial extended positions so that the guide funnels are in their respective working positions. Since the arms 46 and 47 do not perform any tensioning function, it is not necessary that they be provided with hydraulic actuators for raising and lowering the arms, although this may be desirable depending on their size and weight. Although the guide arms 46 and 47 may also be provided as fixed radially extending arms, depending on the particular platform structure in connection with which they are to be used, there is a substantial advantage in providing for the arms to be foldable into a retracted position for handling the central riser column sections.

After assembly of a major portion of the support column 34, the section including the portions 55, 74 and 95 is lowered from the derrick 30 and the retaining hooks 81 are disconnected from the eyes 80 before the section is lowered through the opening 23. After the abovedescribed section is stabbed into place and coupled to the support column 34, the cylinders 70 may be actuated to lower each of the arms 58, 59, 88 and 89 into the extended positions illustrated in FIGS. 3 and 4. The individual risers associated with each of the support arms may then be lowered into position by making up the connections of the multiple sections of each riser and lowering the same through the respective guide funnels associated with each riser. As soon as the section of riser associated with each of the support arms is put in place and connected to the manifold 18, the coupling portion having the flange 66 is attached so that the riser may not extend vertically downward beyond the support arm due to the diameter of the flange 66 being greater than the opening in the bushings 62 and 63. Tensioning of each of the risers may then be individually selected by applying a predetermined fluid pressure to each of the cylinders 70. Since the pressure sensed in the lines 84 may normally indicate the degree of upward directed force or tension in each of the risers, it may not be necessary to individually control each cylinder with respect to the working pressure applied thereto, particularly if all of the arms extend from the support column at about the same angle and all the predetermined tension forces are equal. However, each arm may be selectively biased upward to tension the supported riser. Furthermore, those skilled in the art will appreciate that more or less than two sets of support arms may be used to accommodate the number of risers required for a specific application.

As may be appreciated from the foregoing, the present invention provides an improved riser system having a unique and relatively mechanically simple tensioning mechanism which may be supplied to a substantial number of individual risers in an array extending from a manifold on the seafloor to a floating platform structure. Those skilled in the art will also appreciate that various substitutions and modifications may be made to the present invention without departing from the scope and spirit of the appended claims.

What is claimed is:

1. A marine riser system for conducting well fluids between a subsea manifold and a floating platform structure comprising:

a generally vertical support column extending between said manifold and said platform;

tensioning means interconnecting said support column and said platform for maintaining a predetermined tension on said support column during movement of said platform with respect to said support column;

a plurality of riser conduits extending from said manifold generally vertically upward toward said platform; and means interconnecting said support column and said riser conduits for tensioning said riser conduits to hold said riser conduits in place with respect to said support column during movement of said platform comprising a plurality of arms extending from said support column and pivotally connected to said support column, said arms including means engageable with cooperating means on said riser conduits for supporting said riser conduits vertically with respect to said support column; and hydraulic actuator means urging said riser conduits generally vertically upward with a predetermined biasing force for tensioning said riser conduits with respect to said support column.

2. The riser system set forth in claim 1 wherein:

said arms extend radially outwardly with respect to the central axis of said support column and said arms are spaced apart to provide a generally circular array of said riser conduits about said support column.

3. The riser system set forth in claim 2 wherein:

said plurality of arms include a first set of arms connected to said support column and a second set of arms connected to said support column and spaced apart vertically from said first set, the arms of said second set each being spaced apart circumferentially from the arms of said first set with respect to the central axis of said support column.

4. The riser system set forth in claim 1 or 2 wherein:

said hydraulic actuator means comprise linear extensible hydraulic cylinders connected to respective ones of said arms and to said support column for supporting said arms in a generally horizontal extended position.

5. The riser system set forth in claim 4 wherein:

said cylinders are interconnected between said support column and respective ones of said arms for pivotally moving said arms between a generally vertically extending folded position and a generally horizontally extending working position.

6. The riser system set forth in claim 1 wherein:

each of said arms includes a bushing mounted on a distal end portion of said arm and journalling said respective riser conduit.

7. The riser system set forth in claim 6 wherein:

said arms include bifurcated portions at their distal ends and supporting said bushings for pivotal movement about generally horizontal axes when said arms are disposed in their working positions, respectively.

8. The riser system set forth in claim 1 wherein:

said support column comprises a riser conduit extending from said manifold to said platform and including means for supporting a plurality of hydraulic fluid lines extending between said actuator means and said platform for supplying hydraulic fluid to said actuator means.

9. A marine riser system for conducting well fluids between a subsea manifold and a floating platform structure comprising:

a generally vertical support column extending between said manifold and said platform;

tensioning means interconnecting said support column and said platform for maintaining a predetermined tension on said support column during movement of said platform with respect to said support column;

a plurality of riser conduits extending from said manifold generally vertically upward toward said platform;

a plurality of spaced apart guide arms for said riser conduits, said guide arms being pivotally supported by said support column and being operable to be pivoted between a folded position to form an assembly which may be lowered through a deck opening in said platform to a radially extended working position for guiding said riser conduits; and means interconnecting said support column and said riser conduits for tensioning said riser conduits to hold said riser conduits in place with respect to said support column during movement of said platform.

10. A marine riser system for conducting well fluids between a subsea manifold and a floating platform structure comprising:

a generally vertical support column extending between said manifold and said platform;

tensioning means interconnecting said support column and said platform for maintaining a predetermined tension on said support column during movement of said platform with respect to said support column;

a plurality of riser conduits extending from said manifold generally vertically upward toward said platform;

a plurality of arms extending from said support column and pivotally connected to said support column, said arms including means engageable with cooperating means on said riser conduits for supporting said riser conduits vertically with respect to said support column; and hydraulic actuator means connected to said arms and said support column and operable to move said arms between a folded position for lowering said riser system through a deck opening in said platform and a working position of said arms, said hydraulic actuator means being operable in said working position of said arms to effect tensioning of said riser conduits through said means engageable with said cooperating means on said riser conduits.

11. The riser system set forth in claim 9 wherein:

said guide arms include means for journalling said riser conduits and permitting vertical movement of said riser conduits while laterally restraining said riser conduits with respect to said support column.

12. A marine riser system for interconnecting a plurality of subsea conduits fixed to the seafloor with a floating platform structure comprising:

a generally vertical support column extending between means fixed to the seafloor and said platform structure;

a plurality of riser conduits connected to respective ones of said subsea conduits and extending generally vertically upward toward said platform, said riser conduits being arranged in a substantially circular array around said support column;

a first set of arms connected, respectively, at one end to said support column and to respective ones of said riser conduits;

a second set of arms connected, respectively, at one end to said support column and to further respective ones of said riser conduits at a level spaced vertically from said first set of arms with respect to said support column; and means interconnecting said support column and said arms for vertically tensioning said riser conduits with respect to said support column.

13. The riser system set forth in claim 12 together with:

tensioning means interconnecting said support column and said platform for maintaining a predetermined tension on said support column during movement of said platform structure with respect to said support column.

14. The riser system set forth in claim 12 wherein:

said means interconnecting said support column and said arms includes hydraulic actuator means urging said arms generally vertically upward with a predetermined biasing force for tensioning said riser conduits with respect to said support column.

15. The riser system set forth in claim 12 wherein:

said arms of said second set are each spaced apart circumferentially from the arms of said first set with respect to the central axis of said support column.

16. The riser system set forth in claim 14 wherein:

said hydraulic actuator means comprise linear extensible hydraulic cylinders connected to respective ones of said arms and to said support column for supporting said arms in a generally horizontal extended position.

17. The riser system set forth in claim 16 wherein:

said cylinders are interconnected between said support column and respective ones of said arms for pivotally moving said arms between a generally vertically extending folded position and a generally horizontally extending working position.

18. The riser system set forth in claim 12 wherein:

each of said arms includes a bushing mounted on a distal end portion of said arm and journalling said respective riser conduit.

* * * * *